US009192846B2

(12) United States Patent
Ruiz

(10) Patent No.: US 9,192,846 B2
(45) Date of Patent: Nov. 24, 2015

(54) SNOW SKI TIP CONNECTOR AND TRAINING AID

(71) Applicant: Roberto G. Ruiz, Dallas, TX (US)

(72) Inventor: Roberto G. Ruiz, Dallas, TX (US)

( * ) Notice: Subject to any disclaimer, the term of this patent is extended or adjusted under 35 U.S.C. 154(b) by 0 days.

(21) Appl. No.: 13/951,630

(22) Filed: Jul. 26, 2013

(65) Prior Publication Data

US 2015/0028577 A1 Jan. 29, 2015

(51) Int. Cl.
*A63C 5/16* (2006.01)

(52) U.S. Cl.
CPC ..... *A63C 5/16* (2013.01)

(58) Field of Classification Search
CPC ..... A63C 5/16; A63C 5/00; A63B 69/18
USPC ..... 280/818, 817, 809; 24/300; 441/73
See application file for complete search history.

(56) References Cited

U.S. PATENT DOCUMENTS

| | | | | |
|---|---|---|---|---|
| 3,264,663 | A | 8/1966 | Owens | |
| 3,357,714 | A | 12/1967 | Kuehn | |
| 3,703,299 | A | 11/1972 | Kutchma | |
| 3,992,022 | A | 11/1976 | Albers | |
| 4,828,288 | A | 5/1989 | Humbert | |
| 4,936,603 | A | 6/1990 | Reynaud | |
| 5,531,480 | A | 7/1996 | Foertsch | |
| 7,052,044 | B1 | 5/2006 | Streeter | |
| 8,038,171 | B2 | 10/2011 | Bailey | |
| 8,342,575 | B2 * | 1/2013 | Coleman et al. | 280/818 |
| 8,602,455 | B2 * | 12/2013 | Ligouri et al. | 280/818 |
| 2012/0178067 | A1 * | 7/2012 | Stanfield | 434/247 |

* cited by examiner

*Primary Examiner* — Brodie Follman
*Assistant Examiner* — Brian Cassidy
(74) *Attorney, Agent, or Firm* — Charles D. Gunter, Jr.

(57) ABSTRACT

A ski stabilizing and training device used in combination with a pair of skis to assist a novice skier in learning to ski includes a metal coil spring which acts as an orienting and spacing device for the tip portions of the pair of skis. A pair of attachment members removably attach the metal coil spring to the ski tip portions. The metal coil spring maintains a desired spacing of the skis with the ski tip portions pointed inward. The metal coil spring is of sufficient stiffness to prevent crossing of the ski tip portions while skiing.

6 Claims, 2 Drawing Sheets

SNOW SKI TIP CONNECTOR AND TRAINING AID

BACKGROUND OF THE INVENTION

1. Field of the Invention

This invention relates generally to ski accessories and attachments, and more particularly pertains to a snow ski stabilizing device for training a novice skier in downhill skiing, especially a young child.

2. Description of the Prior Art

Beginning snow skiers often have difficulty learning to keep the tips of their skis together. In the best of situations a natural walking stance when superimposed onto a pair of skis would result in skis that are parallel. Unfortunately, for many beginners, it is far more likely that the skis will naturally result in outward pointing ski tips, which will have the almost sure consequence of causing the inexperienced skier to do the splits and fall.

Although teaching styles have varied over time and from one ski slope to another, most skiers will begin by mastering the snowplow, or wedge, before learning to keep their skis parallel. The snowplow maneuver has the tips of the skis pointing inward with the tails further apart than the tips. In this position the skier tends to place more weight on the inner edges of the skis resulting in a controlled descent of the ski slope. The angle of the skis is useful to control the skier's speed, even to a stop. A wider angle with the tails of the skis relatively much further apart than the tips will traverse the slope much more slowly than a narrower angle. The goal of the beginning skier is to graduate to skiing with skis parallel. Beginning snow skiers, especially children, often have difficulty creating a wedge shape with their skis. Not only do they have difficulty creating the shape; they also have a hard time holding the shape once they start moving down the slope. Children most often encounter this problem because of a lack of muscle strength and because their motor functions are not yet fully developed.

Quite a number of different ski training devices have been patented over the years for maintaining spacing and proper orientation between skis. For example, U.S. Pat. No. 3,264,663, is an early patent which shows flexible struts for connecting a pair of skis together for training purposes.

U.S. Pat. No. 3,357,714, describes a link which extends from one member which upstands from one of a pair of skis to a member which upstands from the other of the skis. Only one such link is provided and the upstanding members are located near the inner edges of the skis and near the points of inflection of the skis.

U.S. Pat. No. 3,703,299, shows a device for securing the tip ends of a pair of skis together comprising a pair of clamps for attachment to the outside edges of the skis, which clamps are interconnected by a flexible strap or web.

U.S. Pat. No. 3,992,022, describes an instructional aid for holding the tips of a pair of skis together which consists of a first and second clamping means adapted to be mounted on the tips of a pair of skis. One of the clamping means has a U-bend with a shank portion which extends downwards and hooks into an eyelet on a second clamping means attached to the tip of the other ski.

U.S. Pat. No. 4,828,288, describes a ski linking device which comprises two near-symmetrical portions, each with an attachment piece which can be fixed securely to the ski tip, an arm which is integral with the attachment piece, and a joint which interconnects the forward ends of the arms. The joint is preferably of the spherical ball-in-cup type.

U.S. Pat. No. 4,936,603, shows a ski tip connector which comprises a connecting leaf or strip mounted on resiliently flexible members rigidly fixed to the tips of the skis and making it possible to vary the relative position of said skis.

U.S. Pat. No. 5,531,480, shows a ski stabilizing device which includes a pair of block members, each block member attached to the inner edge of one ski adjacent the inflected tip of the ski. Each block member encases a spherical region which registers with a circular aperture located on an inside face of the respective block member. Disposed within each spherical region is a ball. Extending between the block members for connecting each ball is a connecting rod which maintains the skis at a generally fixed distance from each other.

U.S. Pat. No. 7,052,044, shows a tip coupler which comprises two sets of straps, one set to encompass each of the right and left skis. One strap from each set engages an aperture provided near the tip of each ski, while other straps may serve to secure the aperture-engaging strap from disconnecting during use. The two sets of straps are joined to one another by a releasable buckle to allow quick separation of the two skis when desired.

U.S. Pat. No. 8,038,171, shows a ski tip connector comprised of two sleeves which slip over and are secured to the upturned tips of the skis. The sleeves are connected by a length of flexible, stretchable material.

Many of these devices involve an excessive number of components, rendering them expensive, cumbersome, unattractive and difficult to operate under winter conditions. Devices appropriate for use in a training situation, whether by the trainee or the trainer, need to be easily manipulated by a user wearing gloves or mittens with a minimum of effort. They should be inexpensive, easy to attach to skis, have a minimum number of parts, and be easily carried when not in use. The above ski tip connector designs generally fail in one or more of the above listed desirable aspects.

One of the most common and simplest devices that has been used for teaching beginning skiers to keep their ski tips together in order to form a wedge is known as the Edgie Wedgie®. This device consists of a short piece of latex rubber hose with a screw clamp on each end. The clamps fasten to the tips of the skis with the body of the device lying between the skis so as to keep the tips of the skis closer together than the tails. The major drawback of this device is that the piece of latex rubber hose is so flexible that it can sometimes allow the ski tips to actually cross in use, thereby causing the beginning skier to fall.

A need continues to exist, therefor, for a ski tip connector of the type described which overcomes the various deficiencies of the prior art, especially in the area of training devices intended to be used by small children or infants.

SUMMARY OF THE INVENTION

A ski stabilizing and training device is shown for use in combination with a pair of skis disposed for skiing on a ski slope whose contour varies from level to irregular with each ski having a substantially elongated, flat portion, a front, upturned inflected tip portion, and longitudinal inner and outer edges extending along a length of the skis. The ski stabilizing device includes a metal coil spring which acts as an orienting and spacing device for the tip portions of the pair of skis. A pair of attachment members are provided for removably attaching the metal coil spring at either of two opposite extents thereof to the respective inflected tip portion of each ski edge so that the metal coil spring does not contact the slope and impede skiing. The metal coil spring maintains the skis at a generally fixed distance from each other during skiing with the tip portions pointed inward, but does not prevent the independent movement of the skis through a plurality of planes relative to the slope. The metal coil spring is of sufficient stiffness to prevent crossing of the ski tip portions while skiing.

While any number of coil spring designs might be used, one convenient source of this component of the ski stabilizing and training device of the invention is to use a portion of a desired length of a metal coil tube bending set of the type which will be familiar to those skilled in the plumbing arts. One such element having a sufficient stiffness is used for bending ¼ inch copper tube. The attachment members are preferably provided in the form of U-bolt screw clamp type connectors.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

As has been briefly described in the Background portion of the application, the present invention is concerned with a stabilizing and training aid for helping to teach a beginning skier to "snowplow" or form a "wedge" with the skis, to permit the student to acquire a high degree of control early in the skiing skills. The device of the invention is particularly intended to be used with young children who are learning to ski. The snowplow or wedge position is achieved when the tip portions of the skis are close together and the tails are spread, forming a "V" position. In this position and if the knees of the skier are properly bent, the skis will be riding on their inside edges, which is necessary for proper control and teaches the learning skier the importance of edge control for other skiing positions.

Very often a beginner skier, and especially a young child, will find the snowplow position awkward and will experience difficulty in bringing the tips close enough together and getting the proper edge set. Young children may lack the necessary strength to properly assume the desired position. It is, therefore, the principal object of this invention to provide a device which will artificially bring the skis into correct position at the same time helping to control the speed of the skier down a modest slope.

Figure 1:
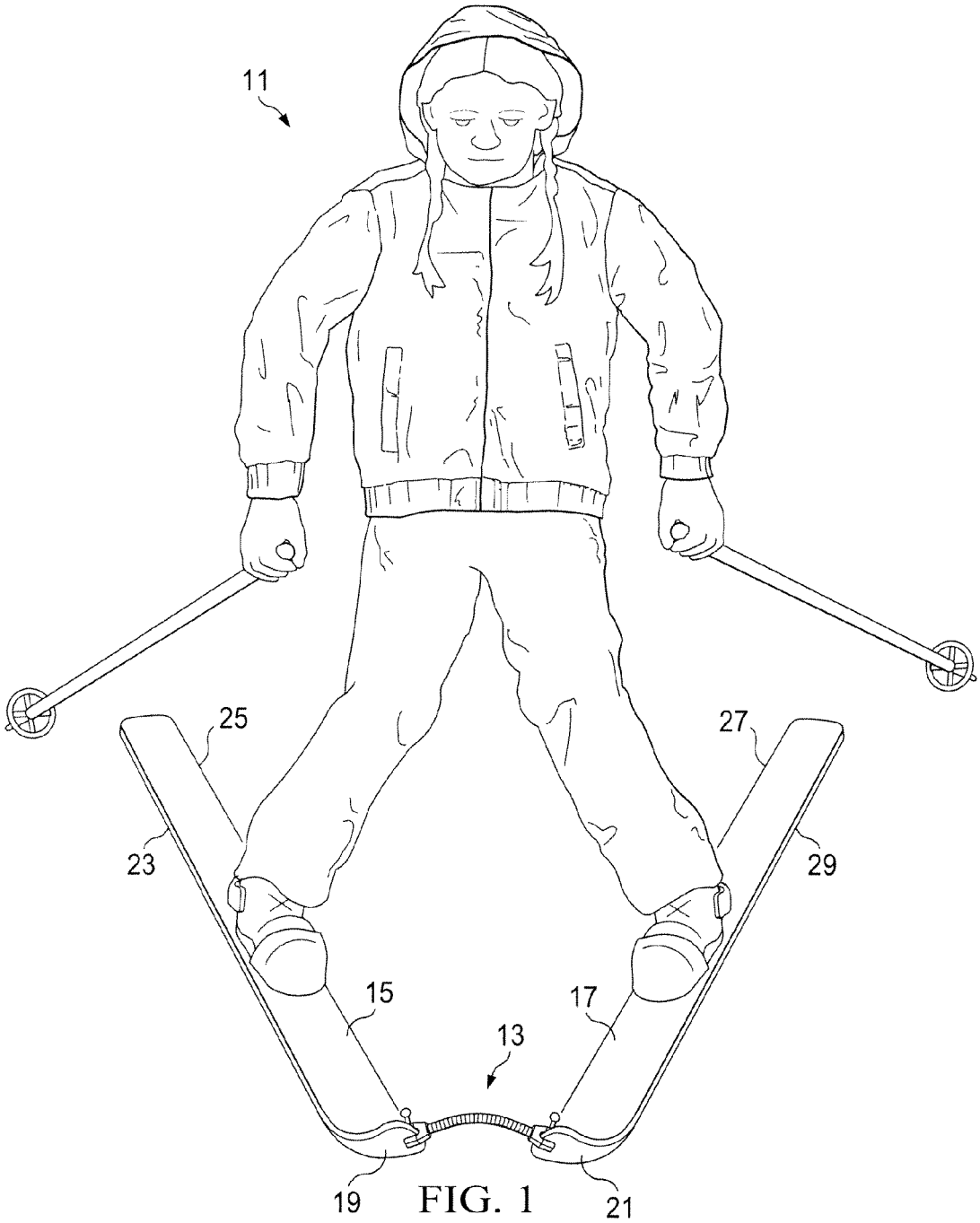
FIG. 1 is a perspective view of a young child skiing using the snow ski tip connector of the invention, the ski tips being pointed inward in a wedge configuration.

FIG. 1 shows a child 11 using the ski stabilizing and training device of the invention, designated as 13. The child is shown with the pair of skis in the desired wedge or snowplow position. It will be noted, that each of the skis is disposed for skiing on a ski slope whose contour varies from level to irregular with each ski having a substantially elongated, flat portion 15, 17, a front, upturned inflected tip portion 19, 21, and longitudinal inner and outer edges 23, 25 and 27, 29, respectively, extending along a length of the skis.

Figure 2:
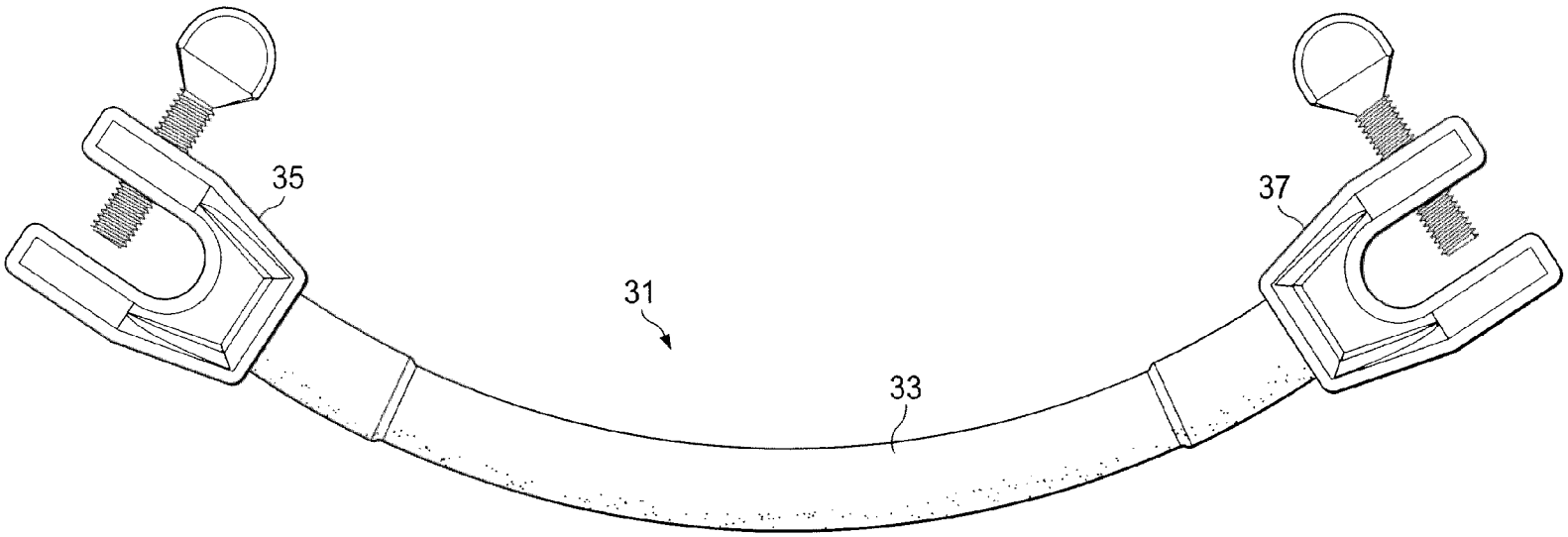
FIG. 2 (PRIOR ART)
FIG. 2 is a perspective view of a prior art ski tip connector using a hose strip of flexible latex rubber and opposing connecting U-bolts to join a pair of ski tips.

The ski stabilizing device of the invention is basically intended as an improvement on the commercially available device known as the Edgie Wedgie® which is sold by Ski Teaching Products, LLC, of Ogden, Utah. Applicant's device is especially useful where the student being taught to ski is a very young child. As shown in FIG. 2, and as has been previously mentioned, the Edgie Wedgie® device 31 uses a short piece of latex rubber hose 33 with a U-bolt screw clamp 35, 37, on each end to attach the ski tip portions of the skis. The clamps fasten to the tips of the skis with the body of the device lying between the skis so as to keep the tips of the skis closer together than the tails. However, there is a drawback in using this device in teaching very young children because the piece of rubber hose is so flexible that it can sometimes allow the ski tips to actually cross in use, thereby causing the beginning skier to fall. The rubber latex portion is somewhat like the consistency of a rubber glove and is easily bent like a cooked spaghetti noodle. While this type of material might be perfectly acceptable in training certain classes of beginning skiers, it is not stiff enough for many young children to be able to handle successfully and fails to prevent the ski tips from crossing.

Figure 3:
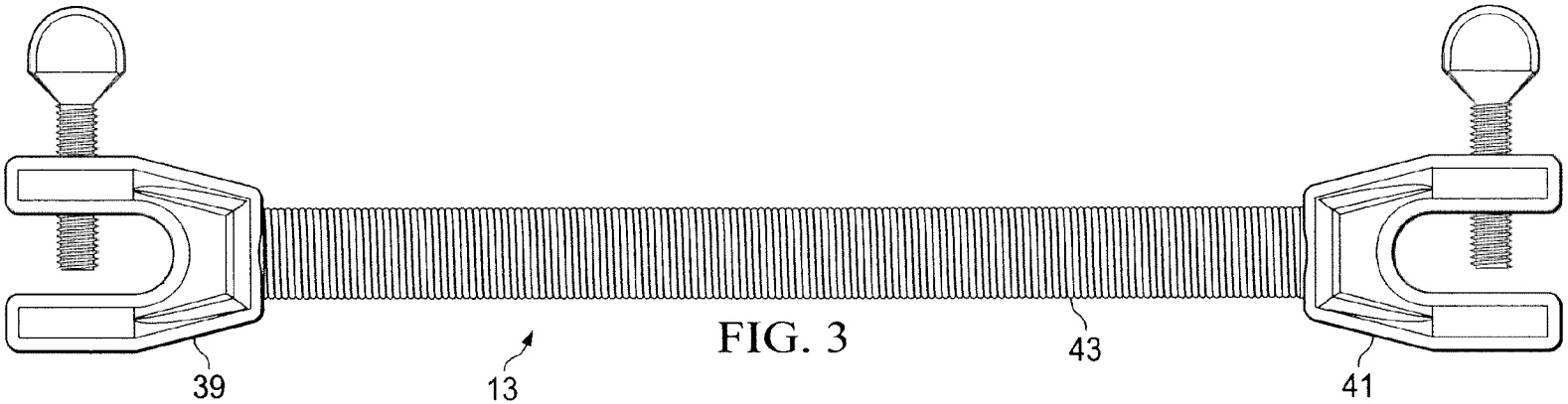
FIG. 3 is a perspective view of a snow ski tip connector of the invention.

The ski stabilizing device 13 of the invention is shown in greater detail in FIG. 3. The device 13 includes as a principal component a metal coil spring 43 which acts as an orienting and spacing device for the tip portions of the pair of skis. Once again, a pair of attachment members 39, 41, are provided for removably attaching the metal coil spring 43 at either of two opposite extents thereof to the respective inflected tip portion of each ski edge so that the metal coil spring does not contact the slope and impede skiing. The attachment members can be, for example, U-bolt screw clamps.

As shown in FIG. 1, the metal coil spring 43 portion of the device maintains the skis at a generally fixed distance from each other during skiing with the tip portions pointed inward, but does not prevent the independent movement of the skis through a plurality of planes relative to the slope. The metal coil spring is of sufficient stiffness to prevent crossing of the ski tip portions while skiing. As mentioned briefly in the Summary of the Invention, the metal coil spring 43 could be obtained from a variety of commercial sources. It is only necessary that the spring have sufficient stiffness to prevent the ski tip portions from crossing during skiing, and yet be flexible enough to not impede normal skiing activities. As has been mentioned, Applicant has found one suitable source of metal coil spring stock material to be commercially available as a portion of what is called a "metal coil tube bending set" in the plumbing trades. One commercially available part set is supplied by BrassCraft® as the "4-Piece Tube Bending Spring Set" supplied for bending ¼, ⅜, and ½ inch OD copper tubing. The ¼ inch OD coil spring is the preferred size, although this particular dimension is not necessarily critical and larger size springs might be used, depending upon the age of the student being trained and the degree of spring stiffness desired.

It should be mentioned that the BrassCraft® tube bending set comes with metal coil springs having flared ends for receiving a piece of copper tubing to be bent within the internal diameter of the coil spring. However, only the straight coil spring portion is used for Applicant's purposes. The flared coil spring end can simply be cut off. In one preferred size device, the length of the spring between the two U-bolt attachment members is approximately six inches. Note also, that as shown in FIG. 3, the spring stiffness is sufficient to maintain a generally straight and stiff condition of the spring so that the application of force would be necessary to bend the spring to the position shown in FIG. 1 of the drawings. The prior art device, shown in FIG. 2, on the other hand is so flexible as to capable of being tied in a knot, if desired.

An invention has been provided with several advantages. The ski stabilizing and training device of the invention can be used to assist beginning skiers in mastering the snow plow or wedge ski position, even in the case of very young children that might otherwise lack the necessary muscle strength or motor skill development. The device is simple in design and economical to manufacture and can be easily constructed from commercially available components. The device is removable from the ski tip portions, for example, when riding a ski lift. The stiffness provided by the metal coil spring component acts to keep the ski tip portions from crossing in use, even when the user is a young child.

While the invention has been shown in various of its forms, it is not thus limited but is susceptible to various changes and modifications without departing from the spirit thereof.

What is claimed is:

1. A ski stabilizing and training device for use in combination with a pair of skis disposed for skiing on a ski slope whose contour varies from level to irregular with each ski having a substantially elongated, flat portion, a front, inflected tip portion, and longitudinal inner and outer edges extending along a length of the skis, the ski stabilizing device comprising:

a metal coil spring formed of a spring material which acts as an orienting and spacing device for the tip portions of the pair of skis;

a pair of U-bolt screw clamp connectors for removably attaching the metal coil spring at either of two opposite extents thereof to the respective inflected tip portion of each ski edge so that the metal coil spring does not contact the slope and impede skiing;

the metal coil spring comprising a single helically wound coil spring spanning a gap created between the U-bolt screw clamp connectors, the single helically wound coil spring being formed of a plurality of coils which overlap and touch one an axed position, each of the U-bolt screw clamp connectors having a U-shaped opening which receives a respective ski tip edge along a lateral side edge thereof and being attached and removed at an attachment point by tightening and untightening an associated locking screw without requiring screws that extend thru the ski itself, the attachment point being generally aligned with the plane of the ski tip edge rather than being perpendicular thereto;

whereby the metal coil spring maintains the skis at a generally fixed distance from each other during skiing with the tip portions pointed inward, but does not prevent the independent movement of the skis through a plurality of planes relative to the slope, while at the same time preventing crossing of the ski tip portions while skiing; and wherein the spring material which is selected for the metal coil spring is of sufficient stiffness to maintain a generally straight and stiff condition on its own, without the presence of additional orienting and spacing components.

2. The ski stabilizing and training device of claim 1, wherein the metal coil spring is made from a portion of a metal coil tube bending set.

3. The ski stabilizing and training device of claim 2, wherein the metal coil spring is made from a metal coil tube bending set for bending ¼ inch copper tube.

4. In combination with a pair of skis used for skiing on a slope, each of the skis having an inflected tip portion and a ski stabilizing and training device for interconnecting the ski tip portions, the ski stabilizing and training device comprising:

a metal coil spring formed of a spring material which acts as an orienting and spacing device for the tip portions of the pair of skis;

a pair of U-bolt screw clamp connectors for removably attaching the metal coil spring at either of two opposite extents thereof to the respective inflected tip portion of each ski so that the metal coil spring does not contact the slope and impede skiing;

the metal coil spring comprising a single helically wound coil spring spanning a gap created between the U-bolt screw clamp connectors, the single helically wound coil spring being formed of a plurality of coils which overlap and touch one another in a relaxed position, each of the U-bolt screw clamp connectors having a U-shaped opening which receives a respective ski tip edge along a lateral aside edge thereof and being attached and removed at an attachment point by tightening and untightening an associated locking screw without requiring screws that extend thru the ski itself, the attachment point being generally aligned with the plane of the ski tip edge rather than being perpendicular thereto;

whereby the metal coil spring maintains the skis at a generally fixed distance from each other during skiing with the tip portions pointed inward, but does not prevent the independent movement of the skis through a plurality of planes relative to the slope, while at the same time preventing crossing of the ski tip portions while skiing; and wherein the spring material which is selected for the metal coil spring is of sufficient stiffness to maintain a generally straight and stiff condition on its own, without the presence of additional orienting and spacing components, such that force would be necessary to bend the metal coil spring to move it from the straight and stiff condition.

5. The combination of claim 4, wherein the metal coil spring is made from a portion of a metal coil tube bending set.

6. The combination of claim 5, wherein the metal coil spring is made from a metal coil tube bending set for bending ¼ inch copper tube.

* * * * *